US005341599A

United States Patent [19]

Cox

[11] Patent Number: 5,341,599

[45] Date of Patent: Aug. 30, 1994

[54] REPLACEMENT VEHICLE WINDOW ATTACHMENT

[76] Inventor: Charles E. Cox, 1016 Superior St., Lot 6, Ft. Myers, Fla. 33916

[21] Appl. No.: 819,078

[22] Filed: Jan. 10, 1992

[51] Int. Cl.[5] ..... E05F 11/38

[52] U.S. Cl. ..... 49/375; 411/44

[58] Field of Search ..... 49/375, 374; 411/44, 411/57, 182, 71, 73, 907, 908

[56] References Cited

U.S. PATENT DOCUMENTS

| | | | |
|---|---|---|---|
| 2,168,242 | 8/1939 | Roethel | 49/375 X |
| 2,921,819 | 1/1960 | Rifkin | 411/44 X |
| 3,505,922 | 4/1970 | Tinnerman | 411/57 |
| 4,240,323 | 12/1980 | Kijima | 411/182 X |
| 4,367,995 | 1/1983 | Mizusawa et al. | 411/57 |
| 5,036,621 | 8/1991 | Iwasaki | 49/375 X |
| 5,065,545 | 11/1991 | Kane et al. | 49/375 |

FOREIGN PATENT DOCUMENTS

| | | | |
|---|---|---|---|
| 979470 | 1/1965 | United Kingdom | 411/71 |

*Primary Examiner*—Peter M. Cuomo
*Assistant Examiner*—Jerry Redman

[57] ABSTRACT

This invention is directed to a new and simplified method of installing a vehicle window glass in the glass carrier or regulator of a vehicle. By this method the glass can be mounted more securely and in considerably less time than has heretofore been required. A flat washer shaped member, preferably formed of nylon, and having a central aperture and a plurality of circumferentially spaced axially extending angular projections partially overlying the central aperture and having humps at about the mid-section of the axially extending surfaces have become known as "window things", because they do so many good things so well. The inner ends of the axially extending members are of slightly less diameter than are the precut internal diameter of the holes in the replacement window. These members, being formed of nylon, will deflect inwardly sufficiently to permit the slightly enlarged humps of the "window things" to be snapped through the precut holes in the replacement windows. The window is then aligned with the regulator, and the screw is threaded through the regulator and through the "window things" at the flat side of the assembly and through the replacement glass to deflect the axially extending members outwardly to securely clamp the window to the regulator.

2 Claims, 3 Drawing Sheets

REPLACEMENT VEHICLE WINDOW ATTACHMENT

BACKGROUND OF THE INVENTION

The "window things" which replace the window rollers and rivets now being used in this development provide a simplified and improved method of resiliently holding the replacement glass on the regulator, and materially reduce the time and effort required to secure the replacement window on a basis where there is no danger of breaking the replacement glass as it is being installed on the regulator. As occasionally happens with the system now being used.

It occasionally happened that a small piece of the broken glass got lodged in the felt molding of the glass. Then when the installer makes his check it will screech. It is then necessary to remove the window, and in doing so with the old equipment the rivets must be drilled out with a high speed drill. If the drill slips the window will generally be broken so that the installer must then start over.

1. Field of the Invention

The field of this invention is to provide a simpler and more secure method of fastening the replacement window glass to the regulator, and a construction which provides a more secure method of holding the replacement glass on the regulator, and a method by which substantial savings timewise are achieved in making the installation. More importantly, the possibility of breaking the glass being installed is eliminated because the rivets which with the old system had to be drilled out are no longer used, and the pressurizing of the rivet with the rivet gun is no longer necessary.

2. Description of the Prior Art

The best prior art or use available is the previously used window replacement rollers and rivets which were cumbersome in use, and in which considerable time was needed in connecting the window to the window regulator by the use of the window rollers and metal rivets which will, on occasion, destroy the replacement glass window being installed during the installation process.

SUMMARY OF THE INVENTION

The "window things" which are preferably made of nylon plastic have four right angled prongs which have humps on their outer axially extending surfaces which contract slightly to permit the "window things" to be snapped through the precut holes in the replacement window glass prior to the installation of the replacement window glass on the regulator. These prongs which partially overlie the small round hole in the washer shaped portions of the "window things" expand when a threaded screw is directed through the precut hole in the regulator and then passes through the small hole on the flat side of the nylon "window things" thereby expanding the prongs to overlie the edges of the window to securely hold the replacement glass in assembled relation with reference to the regulator.

Referring now to the drawings wherein like reference numerals refer to like parts throughout the ten Figures.

DESCRIPTION OF THE PREFERRED EMBODIMENT

Figure 1:
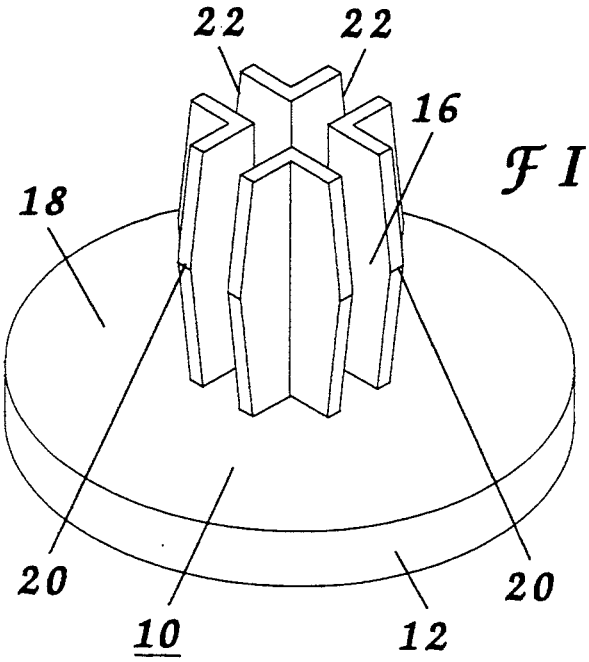
FIG. 1 is an enlarged isometric view of the "window thing" showing one embodiment.

Referring now to the drawings wherein the figures are shown at an enlarged scale to show the various parts to better advantage.

Figure 2:
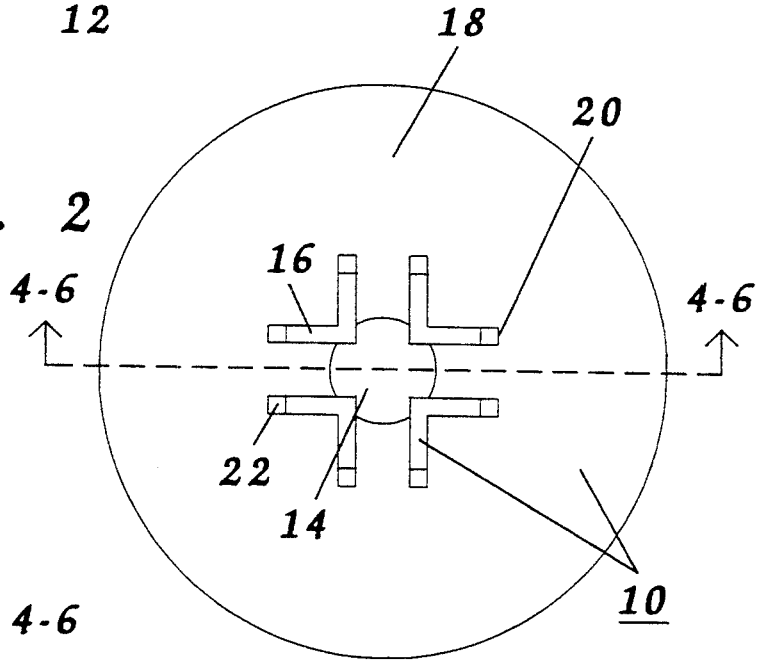
FIG. 2 is an enlarged plan view of the FIG. 1 embodiment. Also shown is the cross section reference "4–6" used in FIG. 4 and FIG. 6.

The "window things" 10 are preferably formed of nylon which is reasonably pliable and will hold its shape to good advantage. The "window things" 10 have a washer type end piece 12 having a flat side 18, a central hole 14 and preferably four radially spaced axially extending prongs 16 which, as illustrated; are preferably right angular sections or other geometrical figures wherein their bases partially overlie the central hole 14 as more clearly shown in FIG. 2. The prongs 16 on the prong side of the "window things" are preferably formed with a hump or increased radial thickness 20 of the axially extending sections.

The other ends of the prongs 16 are reduced in diameter as illustrated at 22 to permit the "window things" to be snapped through the precut holes 26 in the replacement glass 24.

It will be noted that the prongs 16 overlie portions of the hole 14 in the window things to induce the screw 28 to deflect the prongs 16 outwardly as the screw 28 forces the prongs 16 radially outwardly.

Figure 3:
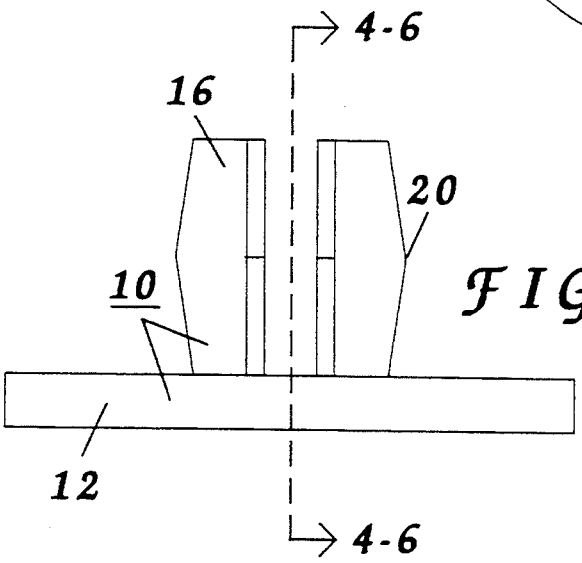
FIG. 3 is an enlarged side view of the FIG. 1 embodiment. Also shown is the cross section reference "4–6" used in FIG. 4 and FIG. 6.
Figure 4:
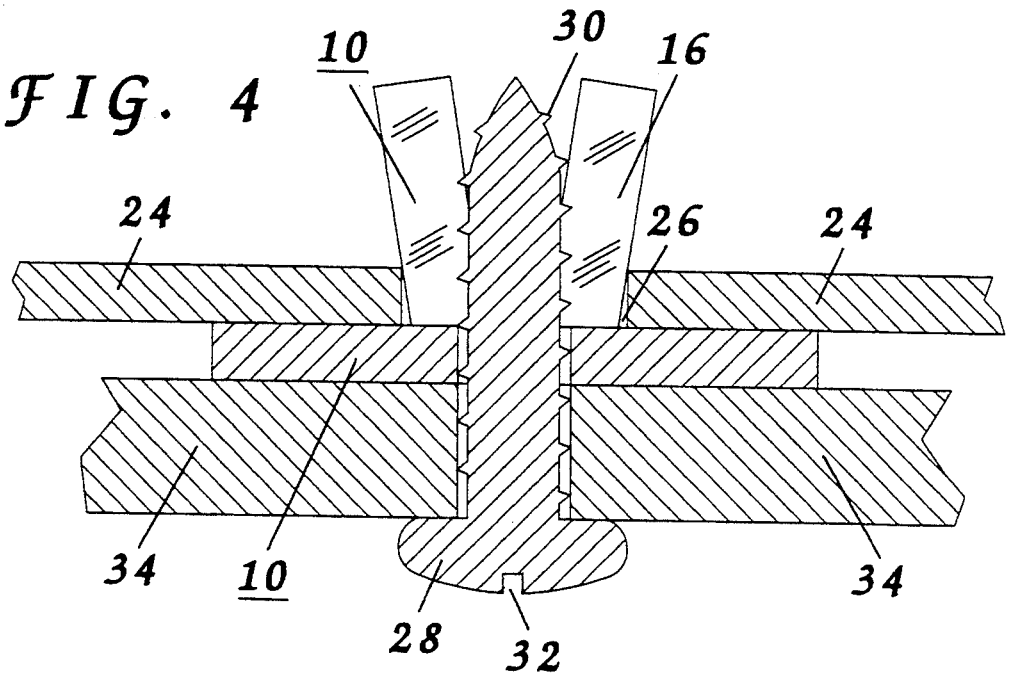
FIG. 4 is an enlarged plan sectional view showing the assembly of a cut away of the window regulator, the second embodiment of a "window thing", a cut away of the replacement vehicle glass and the securing screw.
Figure 5:
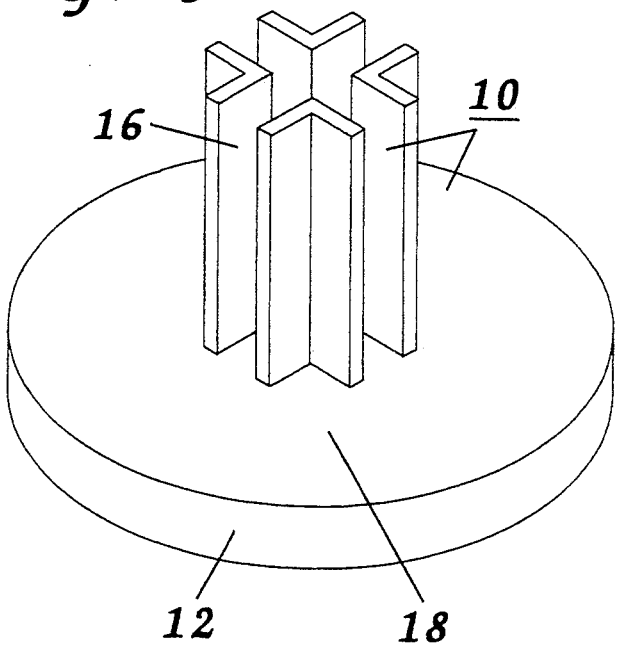
FIG. 5 is an enlarged isometric view of a modified form of the invention.

Referring to FIG. 5, it will be noted that the hump 20 as shown most clearly in FIGS. 1 and 3 is not embodied in the FIG. 5 embodiment.

Figure 6:
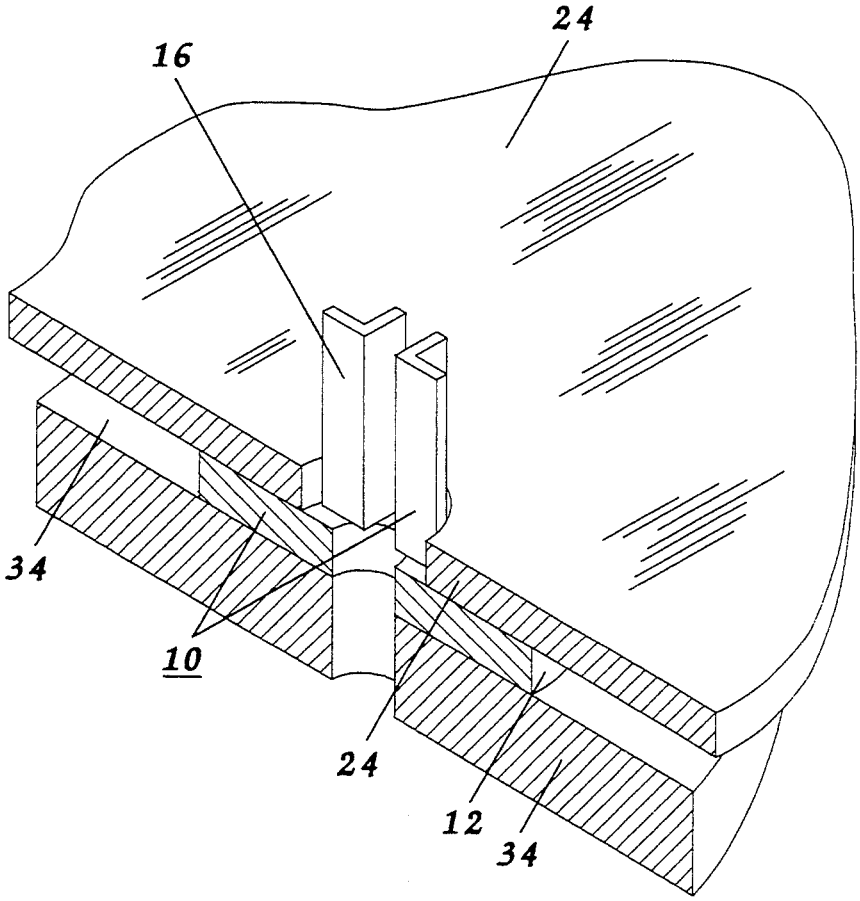
FIG. 6 is an enlarged isometric sectional view showing a cut away section of the window regulator, the second embodiment of a "window thing" and a cut away section of the replacement vehicle glass before insertion and the securing with a screw.

The prongs 16 of FIG. 5 and FIG. 6 are proportioned to slide into the precut holes 26 in the replacement glass 24 as shown in FIG. 6 with sufficient degree of tightness as remain therein.

When the screw 28 is inserted through the window regulator 34, then threaded through the "window things", and as the screw passes into the washer shaped portion of the "window things", and on through the prongs 16 of the "window things" the prong portions 16 of the "window things" are forced apart and are deflected outwardly through the precut holes 26 in the replacement glass 24 to overlie the glass 24 and force the prongs 16 of the "window things" to overlie the replacement glass 24 and securely clamp the glass 24 to the "window things" 10 at the inner side of the washer shaped portion 18 of the "window things" 10, and through the window regulator 34 to securely hold the glass 24 to the window regulator 34.

It will be noted that the prongs 16 of the FIG. 5 embodiment slides through the precut holes 26 in the replacement glass 24 and is expanded as the screw 28 is driven through the regulator 34, then through the "window things", prongs 16 of the "window things" 10 and through the replacement window 24 to clamp the replacement window 24 securely to the prong 16 side of the washer shaped end piece 12 of the "window things" 10.

Figure 7:
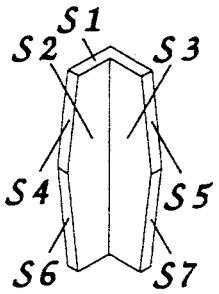
FIG. 7 shows an isometric front view of one of the geometrically extending members.
Figure 8:
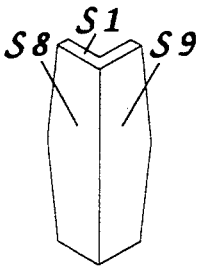
FIG. 8 shows an isometric rear view of one of the geometrically extending members.

FIG. 7 and FIG. 8 shows the surfaces that exist on each of the geometrically extending members with the reference's s1 through s9 to denote the nine surfaces.

Figure 9:
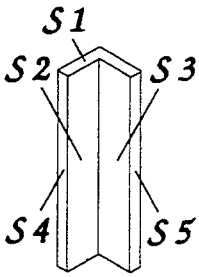
FIG. 9 shows an isometric front view of one of the geometrically extending members of a modified form of the invention.
Figure 10:
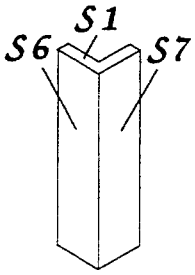
FIG. 10 shows an isometric rear view of one of the geometrically extending members of a modified form of the invention.

FIG. 9 and FIG. 10 show the surface that exist on each of the geometrically extending members with the reference's s1 through s7 to denote the seven surfaces of a modified form of the invention.

I claim:

1. A one piece reusable attachment member adaptable for the attachment and disattachment of a replacement automobile window having an aperture penetrating therethrough, to a window regulator having an aperture penetrating therethrough, utilizing a threaded screw, the threaded screw being insertable and removable from the attachment member, the attachment member comprising;

a washer like member having;

a first side having a central point, the first side being in contact with the window regulator during use, a second side having a central point, the second side being in contact with the automobile replacement window during use, a penetrating aperture from the central point on the first side to the central point on the second side, the washer like member being securely attached to the window regulator by the threaded screw penetrating though the aperture of the window regulator and the aperture of the washer like member during use, four prongs each having;

two opposing relatively perpendicularly intersecting members, the four prongs extending relatively perpendicularly from the washer like member on the second side and partially overlying the aperture of the washer like member, the four prongs being inserted through the penetrating aperture of the automobile replacement window and expanded outward by the placement of the threaded screw through the aperture of the washer like member were the four prongs overlie portions of the automobile replacement window to securely clamp the automobile replacement window to the attachment member during use wherein each prong has a pair of axially extending surfaces and wherein each pair of axially extending surfaces gradually increase in thickness and converges to a maximum radial thickness at substantially a midpoint of said prong.

2. The attachment member defined in claim 1 wherein each of the four prongs have nine surfaces.

* * * * *